US011428089B2

(12) United States Patent
Winkler et al.

(10) Patent No.: US 11,428,089 B2
(45) Date of Patent: Aug. 30, 2022

(54) LOCATING SELF-SETTING DISSOLVABLE PLUGS

(71) Applicant: Halliburton Energy Services, Inc., Houston, TX (US)

(72) Inventors: Albert Winkler, Singapore (SG); Andrew Penno, Singapore (SG); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 154 days.

(21) Appl. No.: 16/753,273

(22) PCT Filed: Apr. 1, 2020

(86) PCT No.: PCT/US2020/026222
§ 371 (c)(1),
(2) Date: Apr. 2, 2020

(87) PCT Pub. No.: WO2020/236320
PCT Pub. Date: Nov. 26, 2020

(65) Prior Publication Data

US 2021/0404304 A1 Dec. 30, 2021

Related U.S. Application Data

(60) Provisional application No. 62/852,108, filed on May 23, 2019, provisional application No. 62/852,129,
(Continued)

(51) Int. Cl.
*E21B 43/116* (2006.01)
*E21B 47/092* (2012.01)
(Continued)

(52) U.S. Cl.
CPC ..... *E21B 43/261* (2013.01); *E21B 23/06* (2013.01); *E21B 33/12* (2013.01);
(Continued)

(58) Field of Classification Search
CPC .. E21B 43/261; E21B 43/116; E21B 2200/08; E21B 47/092
See application file for complete search history.

(56) References Cited

U.S. PATENT DOCUMENTS 4,244,424 A 1/1981 Talbot
7,322,416 B2 1/2008 Burris, II et al.
(Continued)

FOREIGN PATENT DOCUMENTS

CN 107013181 A 8/2017
EP 1264075 B1 6/2018
(Continued)

OTHER PUBLICATIONS

Korean Intellectual Property Office, PCT/US2020/026222, International Search Report and Written Opinion, dated Jul. 27, 2020, 13 pages, Korea.
(Continued)

*Primary Examiner* — Catherine Loikith
(74) *Attorney, Agent, or Firm* — Haynes and Boone, LLP

(57) ABSTRACT

A magnetic system for determining a position of an untethered dissolvable frac package for use in a hydraulic fracturing or stimulation operation. The system includes an array of magnets operable to produce a magnetic field that is operably associated with a position downhole along the string. A setting tool of the dissolvable frac package is configured to sense the magnetic fields and deploy a dissolvable frac plug at a predetermined position along the wellbore string.

20 Claims, 7 Drawing Sheets

Related U.S. Application Data filed on May 23, 2019, provisional application No. 62/852,161, filed on May 23, 2019, provisional application No. 62/852,153, filed on May 23, 2019.

(51) Int. Cl.

| | |
|---|---|
| ***E21B 43/26*** | (2006.01) |
| ***E21B 33/12*** | (2006.01) |
| ***E21B 23/06*** | (2006.01) |
| ***E21B 33/129*** | (2006.01) |
| ***E21B 34/06*** | (2006.01) |
| ***E21B 43/117*** | (2006.01) |
| ***E21B 43/27*** | (2006.01) |
| ***E21B 33/13*** | (2006.01) |
| ***E21B 43/267*** | (2006.01) |

(52) U.S. Cl.

CPC ..... *E21B 33/1294* (2013.01); *E21B 33/13* (2013.01); *E21B 34/063* (2013.01); *E21B 43/116* (2013.01); *E21B 43/117* (2013.01); *E21B 43/267* (2013.01); *E21B 43/27* (2020.05); *E21B 2200/08* (2020.05)

(56) References Cited

U.S. PATENT DOCUMENTS

| | | | |
|---|---|---|---|
| 7,363,967 | B2 | 4/2008 | Burris, II et al. |
| 8,276,670 | B2 | 10/2012 | Patel |
| 8,342,094 | B2 | 1/2013 | Marya et al. |
| 9,217,319 | B2 | 12/2015 | Frazier et al. |
| 9,464,508 | B2 | 10/2016 | Lerche et al. |
| 9,587,475 | B2 | 3/2017 | Frazier et al. |
| 9,797,238 | B2 | 10/2017 | Frosell et al. |
| 9,920,621 | B2 | 3/2018 | Frosell et al. |
| 9,963,955 | B2 | 5/2018 | Tolman et al. |
| 2012/0152519 | A1 | 6/2012 | Rodgers et al. |
| 2013/0062055 | A1 | 3/2013 | Tolman et al. |
| 2013/0292174 | A1 | 11/2013 | Harvey et al. |
| 2014/0027127 | A1 | 1/2014 | Frazier et al. |
| 2015/0275643 | A1 | 10/2015 | Holder et al. |
| 2016/0040520 | A1 | 2/2016 | Tolman et al. |
| 2017/0175500 | A1 | 6/2017 | Robey et al. |
| 2017/0234103 | A1 | 8/2017 | Frazier |
| 2017/0314372 | A1 | 11/2017 | Tolman et al. |
| 2018/0163503 | A1 | 6/2018 | Fripp et al. |
| 2018/0171744 | A1 | 6/2018 | Markel et al. |
| 2020/0370421 | A1* | 11/2020 | Fripp ..... E21B 47/09 |

FOREIGN PATENT DOCUMENTS

| | | | |
|---|---|---|---|
| WO | WO-2013184238 | A1 | 12/2013 |
| WO | WO-2018013131 | A1 | 1/2018 |

OTHER PUBLICATIONS

Korean Intellectual Property Office, PCT/US2020/032255, International Search Report and Written Opinion, dated Aug. 12, 2020, 17 pages, Korea.

Korean Intellectual Property Office, PCT/US2020/032257, International Search Report and Written Opinion, dated Aug. 20, 2020, 15 pages, Korea.

Korean Intellectual Property Office, PCT/US2020/032229, International Search Report and Written Opinion, dated Aug. 25, 2020, 12 pages, Korea.

* cited by examiner

LOCATING SELF-SETTING DISSOLVABLE PLUGS

CROSS REFERENCE TO RELATED APPLICATIONS

This application is a U.S. national stage patent application of International Patent Application No. PCT/US2020/026222 filed on Apr. 1, 2020, which claims priority to U.S. Provisional Application No. 62/852,108 entitled "Locating Self-Setting Dissolvable Plugs," U.S. Provisional Application Nos. 62/852,129 entitled Dissolvable Setting Tool for Hydraulic Fracturing Operations, 62/852,153 entitled Acid Fracturing with Dissolvable Plugs and 62/852,161 entitled Dissolvable Expendable Guns for Plug and Perf Applications, each filed on May 23, 2019, the disclosures of each of which are hereby incorporated by reference.

FIELD OF THE DISCLOSURE

This disclosure relates, in general, to equipment utilized in conjunction with operations performed in relation to hydraulic stimulation and fracturing of subterranean wells. In particular, the disclosure relates to systems and methods for locating a frac package at an operating position in a wellbore.

BACKGROUND

After drilling each section of a wellbore that traverses one or more hydrocarbon bearing subterranean formations, individual lengths of metal tubulars are typically secured to one another to form a casing string that may be cemented within the wellbore. This casing string provides wellbore stability to counteract the geomechanics of the subterranean formations such as compaction forces, seismic forces and tectonic forces, thereby preventing the collapse of the wellbore and provides isolation between sections of the reservoir. To produce fluids into the casing string, hydraulic openings or perforations are typically made through the casing string that extend a distance into the geologic formation.

Hydraulic fracturing or stimulation operations may be conducted in the wellbore, which may include a vertical section extending from a surface location, a transition section and a relatively long horizontal section. Various downhole tools may be positioned in each section of the wellbore to conduct hydraulic fracturing or stimulation operations. These downhole tools may include frac plugs, setting tools, and perforating guns, which may be coupled together on a tool string known as a frac package. Traditionally, frac packages are positioned in the wellbore using a service string or wireline that extends to a surface location. Positioning frac packages at the proper depth and location along the casing string with wireline and service strings may be challenging and time consuming, particularly in the long horizontal sections where gravity alone may not be relied upon to advance the frac packages.

DESCRIPTION OF ILLUSTRATIVE EMBODIMENTS

Figure 1:
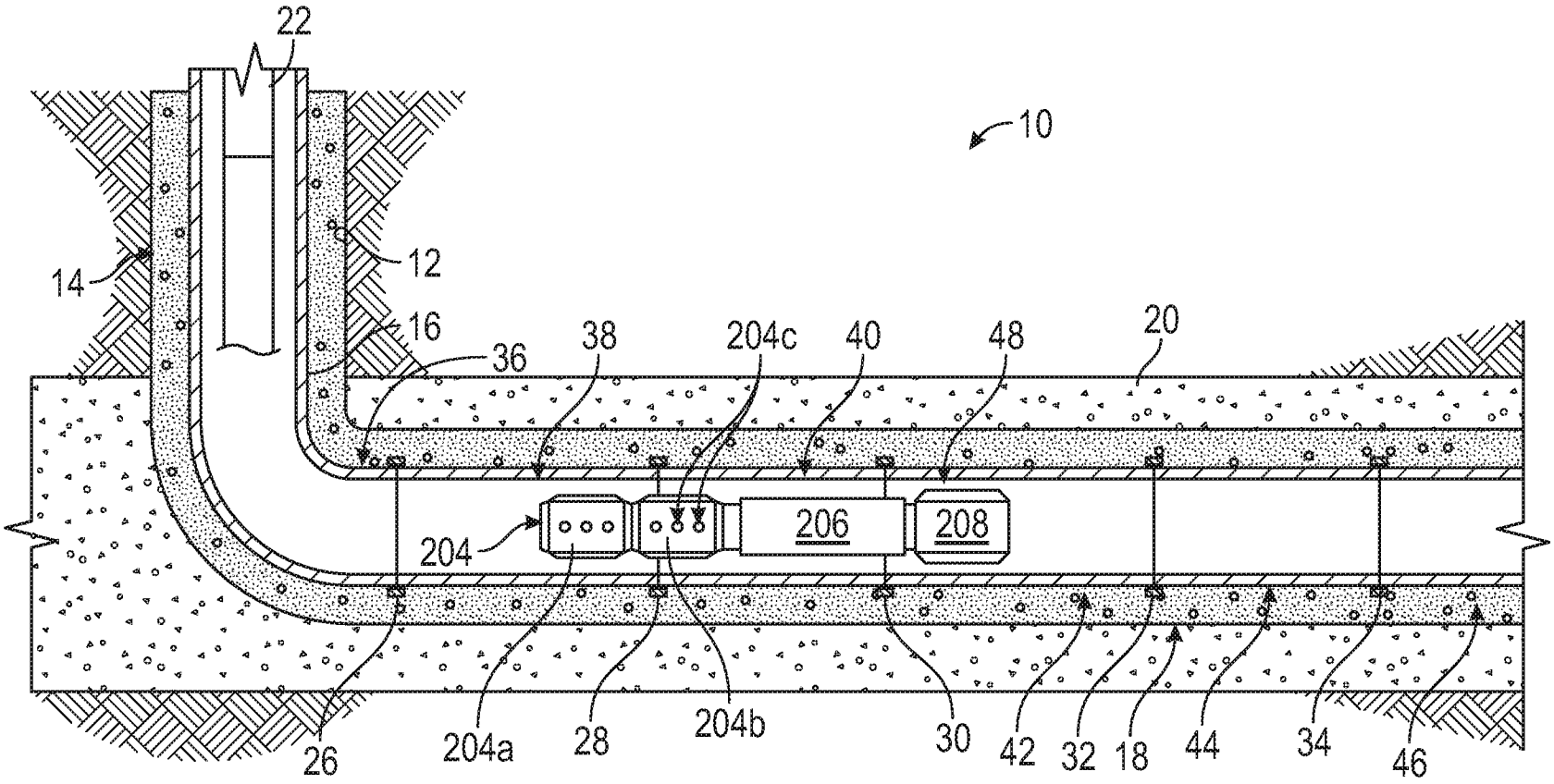
FIG. 1 is a schematic illustration of a wellbore system employing an untethered frac package, which may be secured at a predetermined position in the wellbore and operated in response to detecting one or more passive depth markers in accordance with one or more example embodiments of the present disclosure.

Embodiments of the present disclosure relate to deploying and positioning an untethered dissolvable frac package in a casing string for a hydraulic fracturing or stimulation operation. An untethered frac package does not require a service string or wireline for downhole placement at a predetermined depth appropriate for perforating. The depth of the frac package may be determined by detecting passive depth markers placed in the casing string, and the frac package may be responsive to detecting a specific passive depth marker to set itself in the casing and perforate the wellbore at the predetermined depth. The frac package may be constructed of dissolvable materials such that removal of the frac package from the wellbore may be achieved by circulating fluids through the wellbore.

Generally, difficulties may arise transitioning a frac package from the vertical section of the wellbore to the horizontal section of the wellbore using a service string or wireline due to, for example, lack of gravity assistance in conveyance once the frac package reaches and certain distance from the vertical section of the wellbore. In addition, the deployment of a service string or wireline to lower the tool leads to rig downtime and added risk and expense. As such, an alternative method of conveyance, such as pumping an untethered frack package along the deviated and horizontal sections of the wellbore would be helpful.

Knowledge of the precise location of the frac package string within the casing string may be necessary when positioning the frac package downhole. Determination of a true downhole depth measurement, however, may be difficult due to, for example, inaccuracies in a depth reference log, elongation from thermal effects, buckling, stretching or friction effects, or other unpredictable deformations in the length of casing strings positioned in the wellbore.

After frac packages have been positioned within the wellbore, they may require actuation from a first operating state to a second operating state or require actuation between various operating states. For example, a frac plug may require actuation from an unset configuration to set configuration. The untethered dissolvable frac packages of the present disclosure may eliminate difficulties in the actuation process for many downhole tools, which may involve tubing movement, tool movement, application of wellbore pressure, application of fluid flow, dropping of balls on sleeves, hydraulic pressure, electronic means or combinations of the above. Following the actuation process, confirmation of the actuation of the downhole tool may be desirable.

After the hydraulic fracturing or stimulation operation is complete the untethered dissolvable frac packages may be dissolved in place, removing difficulties and expense of removing the frac packages via a workstring, service string or wireline, requiring another run downhole, or the difficulties associated with leaving frac package in the casing string. Removal of the frac package using a service string or wireline again requires an additional run downhole and leads to additional risk and rig downtime. Alternatively, if the frac package is left in the casing string it limits future wellbore operations during wellbore production.

While the present disclosure is described herein with reference to illustrative embodiments for particular applications, it should be understood that embodiments are not limited thereto. Other embodiments are possible, and modifications can be made to the embodiments within the spirit and scope of the teachings herein and additional fields in which the embodiments would be of significant utility. Further, when a particular feature, structure, or characteristic is described in connection with an embodiment, it is submitted that it is within the knowledge of one skilled in the relevant art to implement such feature, structure, or characteristic in connection with other embodiments whether or not explicitly described.

It would also be apparent to one of skill in the relevant art that the embodiments, as described herein, can be implemented in many different embodiments of software, hardware, firmware, and/or the entities illustrated in the figures. Any actual software code with the specialized control of hardware to implement embodiments is not limiting of the detailed description. Thus, the operational behavior of embodiments will be described with the understanding that modifications and variations of the embodiments are possible, given the level of detail presented herein.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Illustrative embodiments and related methodologies of the present disclosure are described below in reference to FIGS. 1-12 as they might be employed. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments and configurations thereof may be implemented.

FIG. 1 is a schematic illustration of a wellbore system 10 in which an untethered dissolvable frac package 48 is deployed in a wellbore 12 according to an embodiment of the present disclosure. In the illustrated embodiment, the wellbore 12 extends through the various earth strata. Wellbore 12 has a substantially vertical section 14, and also has a substantially horizontal section 18 that extends through a hydrocarbon bearing subterranean formation 20. As illustrated in FIG. 1, a casing string 16 is cemented in both the vertical and horizontal sections 14, 18. In other embodiments (see FIG. 12), a liner 1216 may be installed in the horizontal section 18, and in other embodiments, portions of the wellbore may be open hole.

It will be appreciated by those skilled in the art that even though FIG. 1 depicts a substantially vertical section 14 and substantially horizontal section 18 of the wellbore 12, the embodiments described in the present disclosure are equally applicable for use in wellbores having other directional configurations including deviated wellbores, slanted wellbores, diagonal wellbores, combinations thereof, and the like. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Positioned within wellbore 12 and extending from the surface is a tubing string 22. The frac package 48 is untethered from the tubing string 22, although in other embodiments, the frac package 48 may be lowered through the vertical section 14 on the tubing string 22 and untethered upon reaching the horizontal section 18. Tubing string 22 provides a conduit for formation fluids to travel from formation 20 to the surface and for injection fluids to travel from the surface to formation 20. Casing string 16 includes a plurality of couplings 26, 28, 30, 32, 34, which may be defined between individual lengths of metal tubulars in the casing string 16. Each of the couplings 26, 28, 30, 32, 34 comprises a passive depth marker which may be detected by the frac package 48 as it moves through the casing string 16 to provide an indication of the depth of the frac package 48 in the casing string 16. For example, each of the couplings 26, 28, 30, 32, 34 may include at least one array of magnets or other passive depth marker, and each of which is positioned between potential frac package setting points 36, 38, 40, 42, 44, 46 thereby defining potential production intervals. In the illustrated embodiment, couplings 26, 28, 30, 32, 34 and associated array of magnets serve to locate and position the frac package 48. Each coupling 26, 28, 30, 32, 34 and associated array of magnets may include a unique digital signal associated with the distribution profile of the magnets within the array, and in some embodiments, each coupling 26, 28, 30, 32, 34 include a similar magnetic signature. In other embodiments, passive depth markers may include changes in material, physical surface features such as grooves or protrusions, or any other characteristic in the casing string 16 that may be detected by a sensor carried on the frac package 48 and from which a depth in the wellbore may be identified.

The frac package 48 includes a perforating gun section 204 at an upper end thereof, which may include one or more perforating guns 204*a*, 204*b*. As illustrated, a setting tool 206 is operably coupled between the perforating gun section 204 and a frac plug 208. In other embodiments, a setting tool may be coupled below the frac plug or as an integral component of the frac plug without departing from the scope of the disclosure. As depicted, frac package 48 can be pumped along the horizontal section 18 towards the toe of the wellbore. A fluid pumped into the wellbore 12 propels the frac package 48 downhole. In some embodiments (not shown) a frac package may include radially extending fins to facilitate propelling the frac package with the fluid. The frac package 48 senses the magnetic fields produced by each coupling 26, 28, 30, 32, 34 and associated array of magnets, and the setting tool 206 within the frac package 48 sets the frac plug 208 at or in proximity to a predetermined location according to set point positions 36, 38, 40, 42, 44, 46 thereby defining the perforation points along the wellbore 12.

Figure 2:
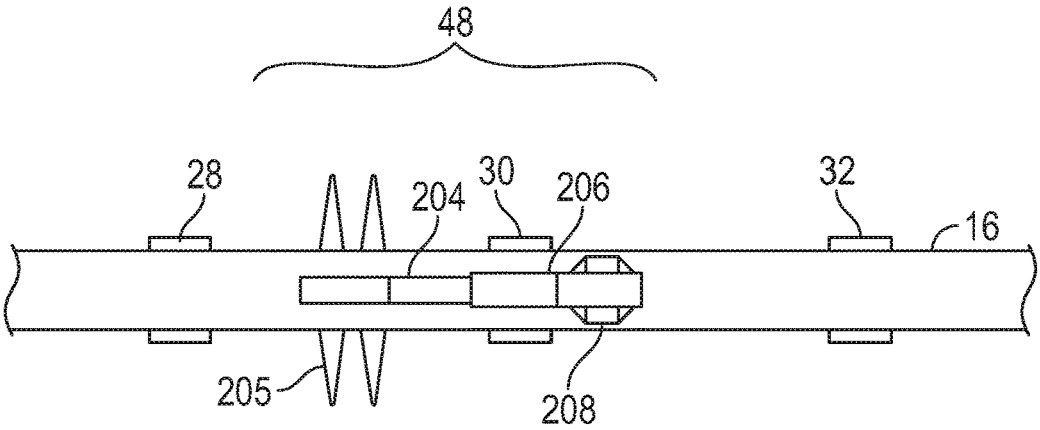
FIG. 2 is a schematic view of a portion of the wellbore system of FIG. 1 illustrating the untethered frac package detecting a predetermined casing coupling in the wellbore with a setting tool of the frac package, setting the frac plug and firing a first perforating gun of the frac package at a first location in response to detecting a predetermined casing coupling.
Figure 3:
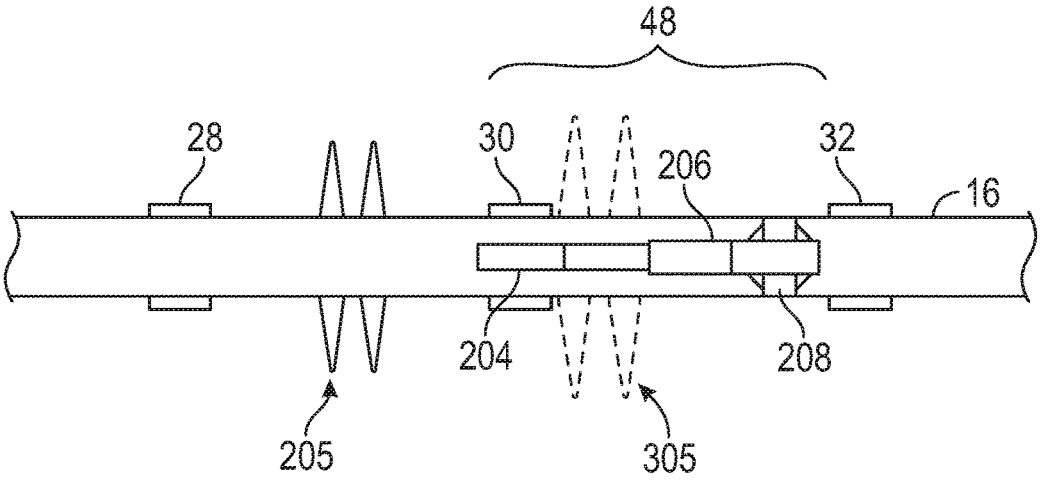
FIG. 3 is an enlarged view of the untethered frac package at a predetermined time delay after detecting the casing coupling wherein a second perforating gun of the frac package is fired a second location and a frac plug of the frac package is set.
Figure 4:
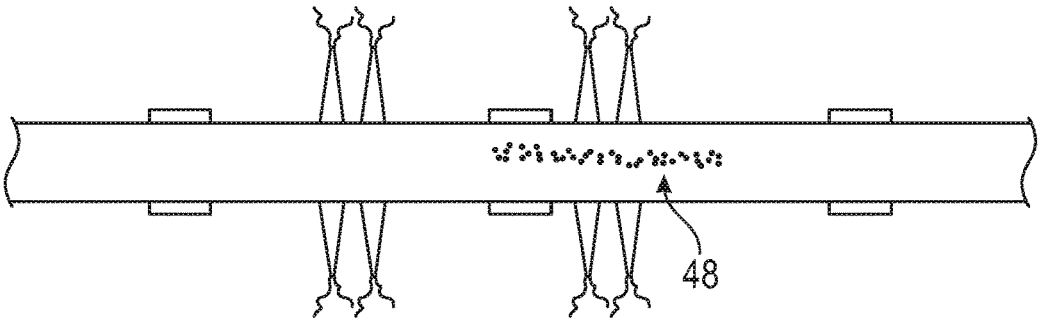
FIG. 4 illustrates the wellbore after a hydraulic fracturing or stimulation operation is complete and the frac package has been dissolved.

Referring now to FIGS. 2-4, with continued reference to FIG. 1, illustrated is the exemplary untethered dissolvable frac package 48 in an operational sequence according to one or more embodiments. Dissolvable frac package 48 includes perforating gun section 204 with perforating charges 204*c* (FIG. 1) on the upper end of the frac package 48 coupled to setting tool 206. Dissolvable frac package 48 includes frac plug 208 located on the lower end of the frac package 48 coupled to the lowered end of the setting tool 206. Setting tool 206 senses the magnetic field produced by couplings 28, 30, 32 and associated array of magnets. Frac package 48 may be autonomous and, as it is pumped into and along the wellbore 12, the setting tool 206 counts each coupling 26, 28, 30 it passes by detecting the magnetic signals produced by the array of magnets associated with each coupling 26, 28, 30 along the casing string 16. Once the setting tool 206 reaches a predetermined target depth and/or position along the casing string 16 the perforating guns 204*a*, 204*b* may be instructed to fire and/or the frac plug 208 may be deployed/set. As illustrated in FIG. 2, when the setting tool 206 detects coupling 30, the setting tool 206 may instruct the first perforating gun 204*a* to fire at a first location, e.g., uphole of the coupling 30. A first perforation cluster 205 may be formed thereby.

As illustrated in FIG. 3, the setting tool 206 may instruct the second perforating gun 204*b* to fire after a predetermined time has elapsed after detecting the coupling 30, wherein the frac package 48 has been pumped downhole. A second perforation cluster 305 may be formed thereby at a second location, e.g., downhole of the coupling 30. During the specified time delay the frac package 48 is pumped along the wellbore 12 and, thus, the second perforation cluster 305 is separated from the first perforation cluster 205. In connection with forming the second perforation cluster 305, the setting tool 206 may instruct the frac plug 208 to set and engage the casing string 16. The setting tool 206 also sets the frac plug 208 to isolate the lower frac zones and individual frac stages below the frac plug 208.

Once the perforation clusters 205, 305 are generated and the frac zones isolated, hydraulic fracturing or stimulation can occur. The hydraulic fracturing or stimulation of the perforation clusters 205, 305 can be performed with proppant or with acid. In one embodiment, the hydraulic fracturing or stimulation of the perforation clusters 205, 305 can be performed with a combination of both proppant and acid. Once the hydraulic fracturing or stimulation operation is completed, the entire frac package 48 degrades in the wellbore fluids as shown in FIG. 4. In some embodiments, the frac plug 208 may dissolve more slowly than the setting tool 206 or the perforating gun section 204 as described below.

In one embodiment, the perforating gun section 204, setting tool 206, and frac plug 208 degrade in water-based fluids. In another embodiment, the frac package 48 degrades in an acid-based fluid. In one embodiment, the majority of the mass from each of the components in the frac-package 48 degrades into individual particles less than one half inch diameter that may be carried to a surface location by circulating fluids in the wellbore 12 or may otherwise not interfere with the fracturing and/or stimulation operation. In some embodiments, the frac package is 48 composed of multiple materials that degrade in different fluids and at different rates. For example, the perforating gun section 204 and the setting tool 206 may be composed of a degradable metal while the frac plug 208 is made of a combination of degradable materials such as metals, plastics, and elastomers. In proppant-based hydraulic fracturing, the hydraulic fracturing process may start with acid then transition to majority proppant. In an acid-based hydraulic fracturing process acid is used extensively. By constructing the perforating gun section 204 and the setting tool 206 from degradable metal, the acid will accelerate the degradation of the two frac package components 204, 206 at a faster rate than the frac plug 208. As a result, the perforating gun section 204 and the setting tool 206 will degrade early in the hydraulic fracturing operation. The plastic and elastomer in the frac plug 208 are more resistant to acid and, therefore, will last longer and maintain pressure retaining integrity during the hydraulic fracturing operation.

In some embodiments, the setting tool 206 may consist of a cavity (not shown), located on the outer surface of the setting tool 206 body, and hatch plate to cover the cavity and create a hermetically sealed chamber. The magnetic field detector 740 (see FIG. 7) or other depth marker detector and associated electronics may be housed within the cavity. In another embodiment, the setting tool consist of an insert section configured to receive a degradable electronic insert that contains the magnetic field detector 740 and associated electronics. In one embodiment, the electronics section and power supply for the setting tool's 206 electronics are dissolvable. In another embodiment, the electronics section and power supply are disintegrated using an explosive shape charge from the perforating gun section 204.

Figure 5:
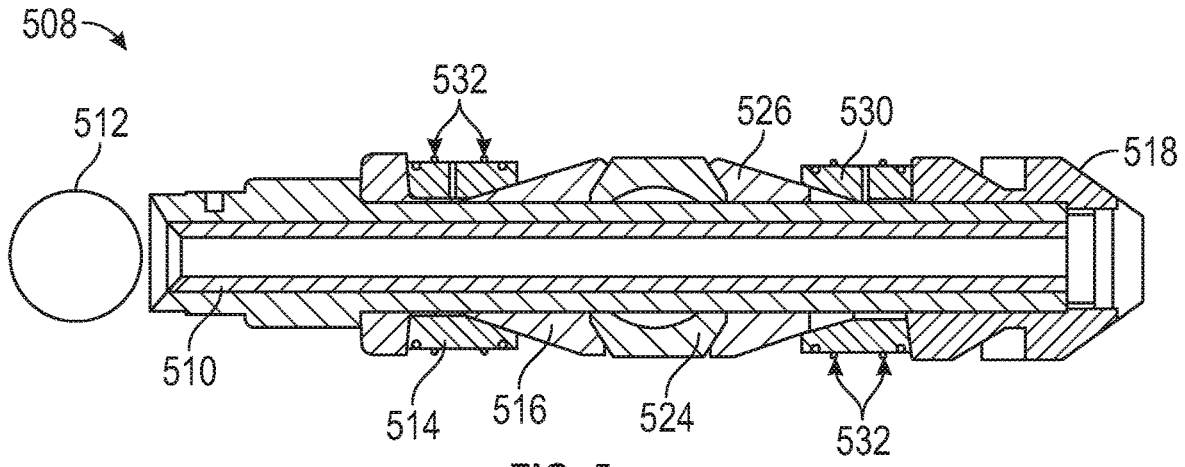
FIG. 5 is an enlarged cross-sectional view of an exemplary dissolvable frac plug with top and bottom slips.

As illustrated in FIG. 5, a frac plug 508 may consist of multiple components where each component may be constructed from a dissolvable plastic, dissolvable rubber, dissolvable metal, and/or other non-dissolvable material. As illustrated in FIG. 5, for example, a mandrel 510, frac ball 512, upper slips 514, upper wedge 516, and mule shoe 518 could all be constructed from a fiber-reinforced dissolvable plastic. The frac plug 508 sealing element 524 may be constructed from a dissolvable elastomer. The lower wedge 526 and lower slips 530 could be constructed from a dissolvable metal. Constructing the lower wedge 526 and lower slips 530 from a dissolvable metal is advantageous because the metals are stronger than the plastic of the mandrel 510, frac ball 512, upper slips 514, upper wedge and mule shoe 518. The lower slips 530 support the hydraulic forces on the frac plug 508. The teeth 532 on the upper and lower slips 514, 530 that bite into the casing string 16 (FIG. 1) can be constructed from non-dissolvable material, such as ceramic or hardened steel. FIG. 5 shows a representative embodiment of a frac plug 508 with both upper slips 514 and lower slips 530.

Figure 6:
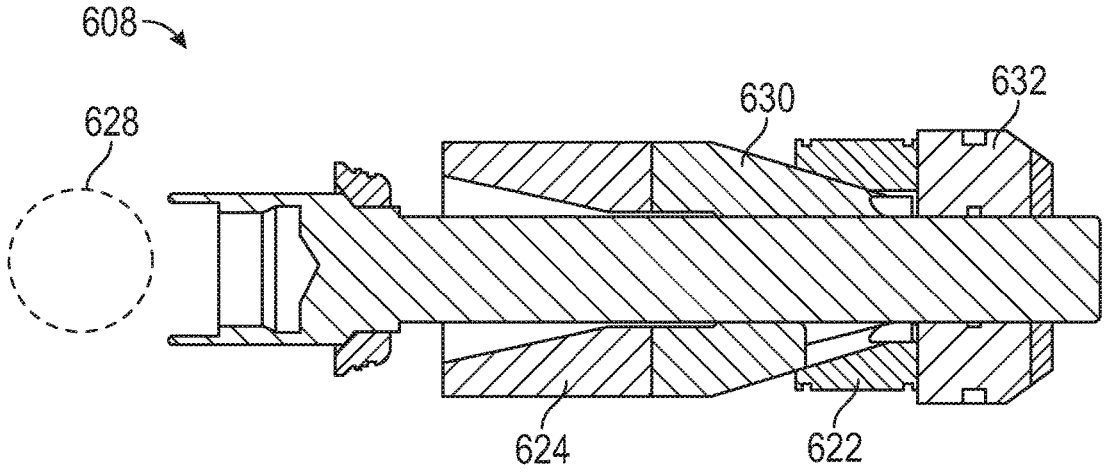
FIG. 6 is an enlarged cross-sectional view of an exemplary dissolvable frac plug with only bottom slips.

In another embodiment, as illustrated in FIG. 6, a frac plug 608 may be configured to have only lower slips 622. In this case, the sealing element 624 is composed of a degradable elastomer, while the ball 628, setting wedge 630, and mule shoe 632 are composed of a degradable plastic, and the lower wedge 630 and lower slips 622 are composed of a degradable metal, while the teeth 634 are composed of a non-degradable material. The degradable plastic material may be one of aliphatic polyesters such as poly (lactic acid) (PLA) and poly (glycolic acid) (PGA). The degradable elastomer material may be one of polyurethane, thermoplastic urethane (TPU), and thiol. The degradable metal may be one of magnesium and aluminum alloys. The non-degradable materials may be one of steel, brass, ceramic, and cast iron. In one embodiment, the degradable materials may be coated with a protective layer to inhibit the degradation process. Types of coatings may be one of metal-based and/or polymer-based materials.

Figure 7:
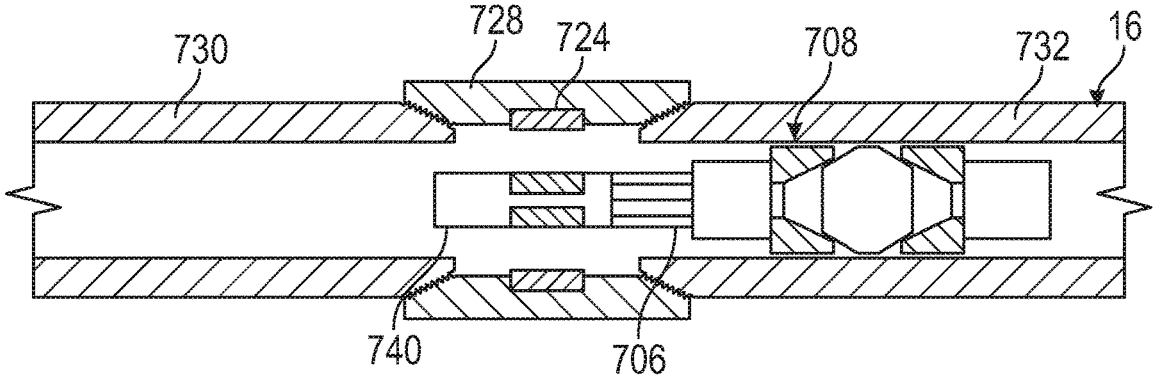
FIG. 7 is an illustration of the frac package setting tool detecting the array of magnets as the passive depth marker and activating the frac plug.

As illustrated in FIG. 7, a passive depth marker such as the array of magnets 724 can be disposed within or co-located with the couplings 728 between individual lengths of metal tubulars 730, 732 in the casing string 16. As the setting tool 706 passes the coupling 728 the magnetic field detectors 740 that are housed in the setting tool 706 detect the magnetic field produced by the array of magnets 724. The setting tool 706 may then deploy the frac plug 708, fires the perforating guns 204*a*, 204*b* (FIG. 1), or executes any preprogrammed set of instructions stored on the setting tool 706 in response to detecting the magnetic field of the array of magnets disposed with in the couplings 728. In other embodiments, an array of magnets may also be disposed at other locations along the casing string 16. In one embodiment, the magnets may be made of permanently magnetic material such as samarium cobalt, neodymium, ferrite, alnico or any combination of the above.

Figure 8A:
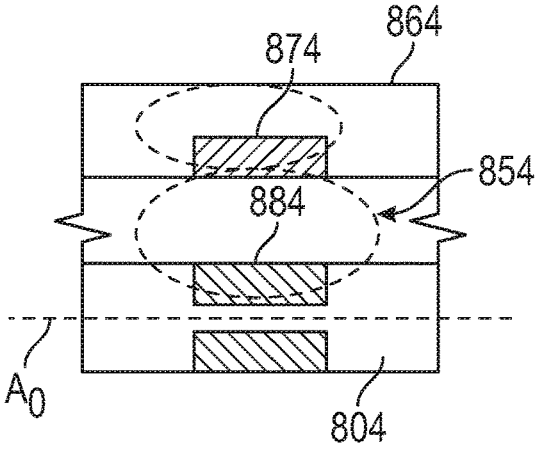
FIG. 8 is an illustration of an axial and radial magnetic field produced by the array of magnets in the string couplings.
Figure 8B:
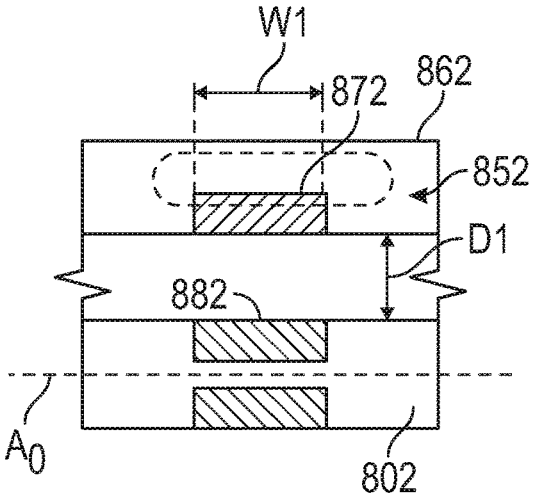
Figure 8C:
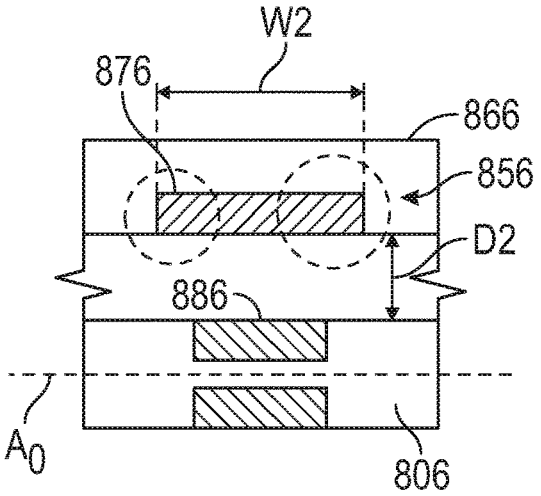

The magnetic field produced by an array of magnets may be oriented axially or radially with respect to the central longitudinal axis Ao of the casing string 16 as depicted in FIGS. 8A through 8C. In embodiments where the magnetic field 854 of an array of magnets 874 is oriented axially (FIG. 8A), then the coupling 864 should be made from non-ferromagnetic material. In embodiments where the magnetic field 852 is arranged radially, and the coupling 862 is constructed of a ferromagnetic material, then a width W1 of the magnets in the array of magnets 872 may be at least one quarter of the distance D1 from the magnets to the magnetic field detector 882 housed in the setting tool 802 such that the magnetic field produced by the array of magnets 872 will extend far enough to be detected by the magnetic field detector 882. FIG. 8C illustrates a radially arranged magnetic field 856. A coupling 866 is constructed of a material that is ferromagnetic, and the width W2 of an array of magnets 876 is substantially larger than a distance D2 from a magnetic field detector 886 in a setting tool 806 and the array of magnets 876. Thus, the magnetic field 856 is readily detectable by the magnetic field detector 886.

In some embodiments, a plurality of magnets may be provided in each array of magnets 872, 874, 876 at each axial coupling 862, 864 and 866 location along the casing string 16, and a single magnetic field sensor may be provided in each of the magnetic field detectors 882, 884,886 housed in the setting tools 802, 804, 806 to detect the magnetic field produced by the plurality of magnets. In other embodiments, a single magnet may be provided in each array of magnets 872, 874,876 at each axial coupling 862, 864 and 866 location along the casing string, 16 and a plurality of magnetic field sensors may be provided in each in each of the magnetic field detectors 882, 884,886 housed in the setting tools 802, 804, 806 to detect the magnetic field. In yet other embodiments, there could be one single magnet disposed along the casing string 16 and one single magnetic field sensor housed in the setting tool 802, 804, 806 to detect the magnetic field. The magnetic field detectors housed in the setting tools 882, 884, 886 include at least one magnetic field sensor. The magnetic field sensor may be one of a variety of magnetic field sensors such as magnetorestrictive sensors, Hall effect sensors, fluxgate magnetometers, or inductive sensors.

Figure 9A:
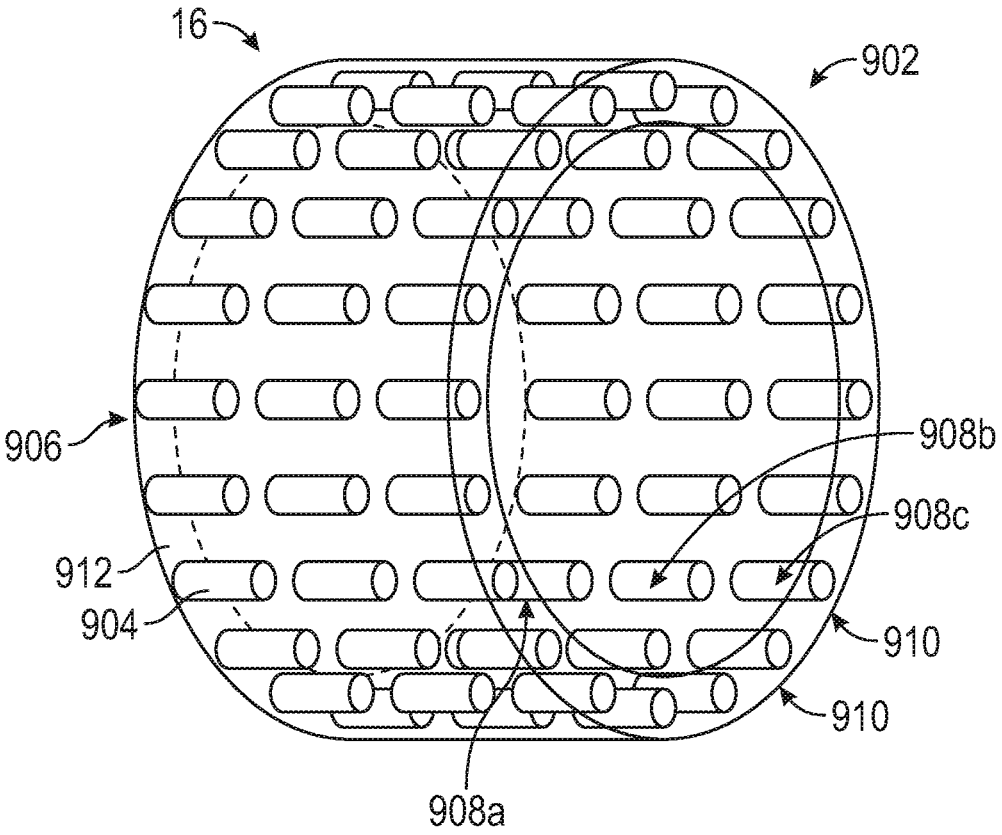
FIG. 9A is an illustration of a pattern of magnets that form a digital identity for the array of magnets.
Figure 9B:
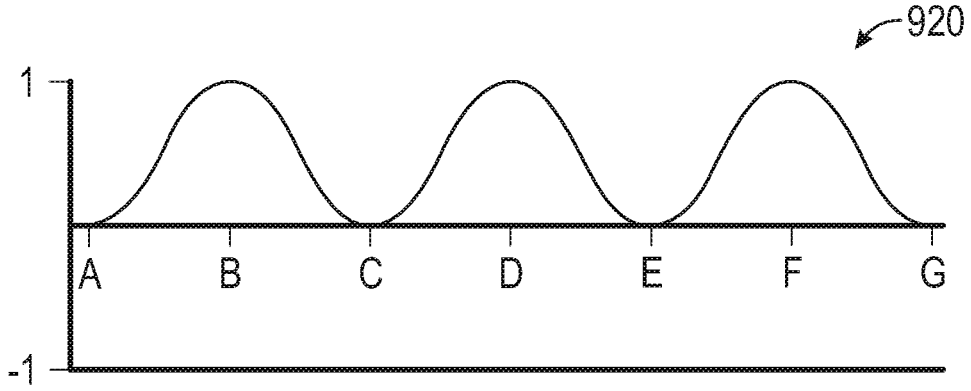
FIG. 9B is an illustration of the resultant magnetic field profile based on the arrangement of magnets in FIG. 9A.

In some embodiments, as illustrated in FIG. 9A, a passive depth marker 902 may include a pattern of individual magnets 904 in an array of magnets 906 arranged to digitally identify a unique location along the casing string 16. A unique digital pattern of the array of magnets may be defined, e.g., by three axially spaced rings 908*a*, 908*b*, 908*c* of magnets 904 in each of twenty circumferentially spaced rows 910. Each of the magnets in the circumferential and axial array 906 may be oriented in a unique predetermined pattern such that the polarity of the of magnets 904 produces a uniquely identifiable signature that can be detected by the depth marker detector such as the magnetic field detectors 882, 884, 886 (FIGS. 8A, 8B and 8C). For example, the coupling 912 including the array of magnets 906 may be located at the heel of the wellbore may contain the array of magnets 906 arranged to produce a specific magnetic field profile 920 as illustrated in FIG. 9B.

In some embodiments, the setting tool 802, 804, 806 is preprogrammed to perform a specific action corresponding to a specific sensed magnetic field profile. For example, the setting tool 802, 804, 806 may be preprogrammed with instructions to cause a frac plug 708 (FIG. 7) to set in the casing string 16 in response to sensing a specific magnetic field profile. In some embodiments, the setting tool 802, 804, 806 may be preprogrammed to perform a plurality of actions corresponding to a plurality of specific sensed magnetic field profiles. For example, the setting tool 802, 804, 806 may be preprogrammed with instructions to cause one or more of the perforating guns 204*a*, 204*b* (FIG. 1) to fire in response to sensing a first specific magnetic field profile and with instructions to cause the frac plug 708 (FIG. 7) to set in response to sensing a second specific magnetic field profile.

In other embodiments, the array of magnets 906 may be replaced another detectable passive depth markers such as passive radio frequency identification (RFID) tags or near-field communication (NFC) circuits and the setting tool magnetic field detector may be replaced with a RFID or NFC interrogator. In some embodiments radioactive markers may be employed. In some embodiments, a combination of different types of depth markers may be deployed in a wellbore string. For example, an array of magnets and an RFID tag may be installed in the same casing coupling, or magnets and RFID tags may be installed to alternate in a predetermined pattern along the wellbore string. Similarly, a combination of depth marker detectors may be employed for detecting depth markers. A single setting tool may include both a magnetic field detector and an RFID interrogator, for example, or frac packages carrying a single type of depth marker detector may be deployed into the wellbore to alternate in a predetermined pattern.

Figure 10:
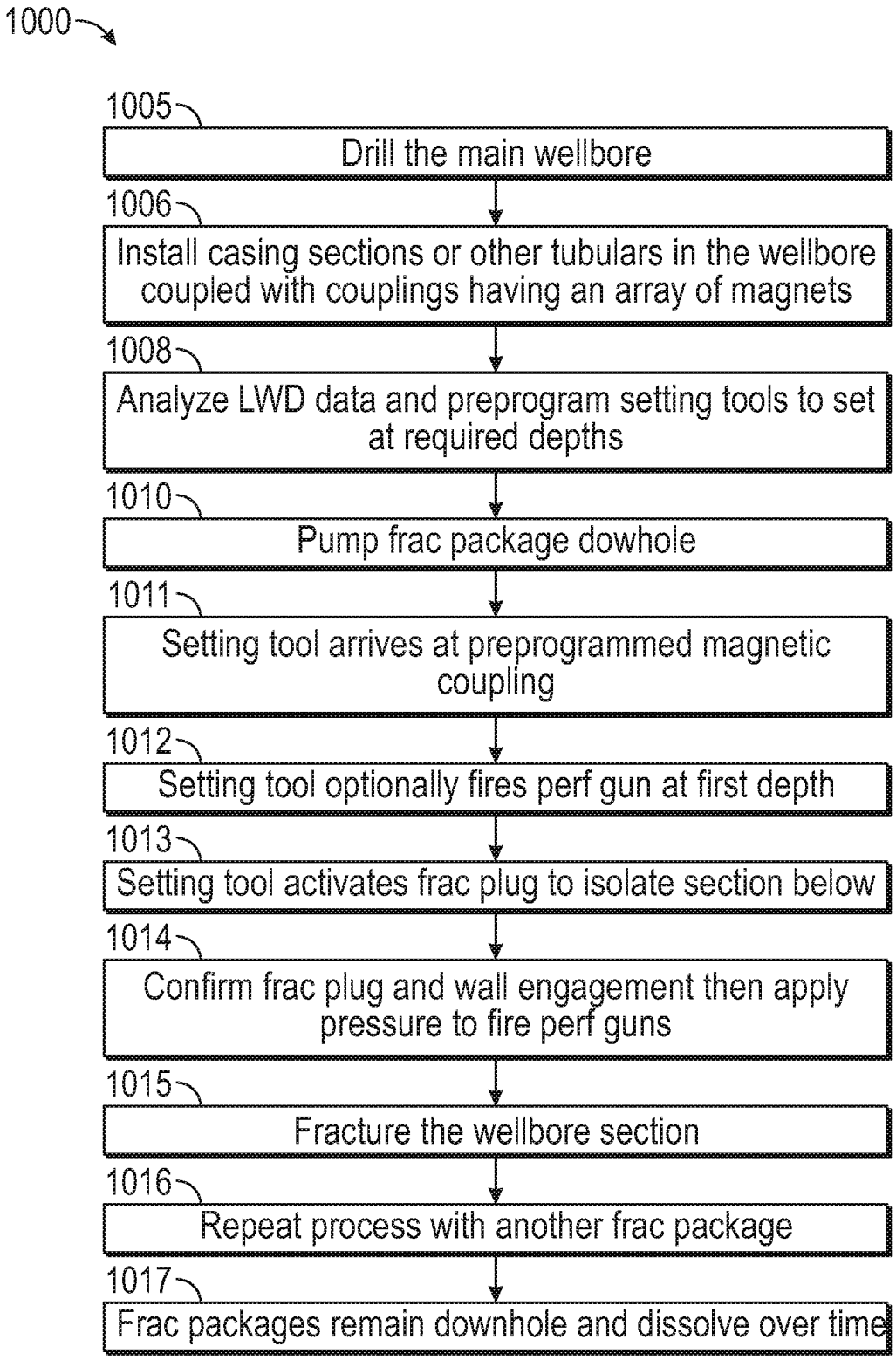
FIG. 10 is a block diagram illustrating a process of deploying the untethered dissolvable frac package downhole and performing a hydraulic fracturing or stimulation operation.

FIG. 10. is a block diagram illustrating an example process 1000 used to deploy an untethered dissolvable frac package 48 (FIG. 1) into a wellbore 12 and perform a hydraulic fracturing or stimulation operation of wellbore 12. First, in step 1005, the wellbore 12 is drilled. All or a portion of the wellbore 12 is then cased with casing string 16, which may be cemented in the wellbore in step 1006. In some embodiments, the entirety of the length of the wellbore 12 is cased and completed where the casing contains the couplings 26, 28, 30, 32, 34 and associated passive depth markers, e.g., array of magnets 724 (FIG. 7) for each coupling 26, 28, 30, 32, 34. In other embodiments, other types of wellbore tubulars may be preconfigured with the couplings 26, 28, 30, 32, 34 with associated array of magnets or another type of passive depth markers. In step 1008, logging while drilling (LWD) or other data may be analyzed to determine appropriate wellbore locations for the frac plug 208 to be set and for perforations e.g., perforation clusters 205, 305 (FIG. 3) to be formed. The setting tool 206 of one or more frac packages 48 may be preprogrammed to set the frac plug 208 and fire the perforating guns 204*a*, 204*b* at the appropriate depths in response to detecting one or more of the magnetic couplings 26, 28, 30, 32, 34. In step 1010, the untethered dissolvable frac package 48 is pumped downhole. In another embodiment, the dissolvable frac packages 48 are first lowered into the wellbore by wireline or tubing string 22 (FIGS. 1 and 12) until the distal end of the vertical section 14 of the wellbore 12 is reached. The wireline or tubing string 22 is detached from the frac package 48. The now untethered frac package 48 is further pumped along the horizontal section 18 of the wellbore 12. In some embodiments, the frac package 48 may be pumped downhole with a fluid employed in hydraulic fracturing or stimulation in subsequent steps. In step 1011, the dissolvable frac package 48 arrives at a predetermined magnetic coupling 26, 28, 30, 32, 34. In another embodiment, the setting tool 206 counts the number of times a passive depth marker is passed and executes a predetermined set of instructions once a certain count is reached. In an optional step 1012, the setting tool 206 executes instructions to cause one or more of the perforating guns 204*a*, 204*b* to fire either instantly or after a predetermined time delay after reaching the predetermined magnetic coupling 26, 28, 30, 32, 34 or passive depth marker. The setting tool 206 may supply a hydraulic pressure to the perforating guns 204*a*, 204*b* to cause the perforating guns 204*a*, 204*b* to fire. In many instances, the step 1012 may be eliminated and the procedure 1000 proceeds directly from step 1011 to step 1013, where the setting tool 206 activates the frac plug 208 element 524 (FIG. 5) instantly or at a predetermined time after reaching the predetermined magnetic coupling 26, 28, 30, 32, 34 or other passive depth marker. The setting tool 206 may employ a charge or hyrdostatic pressure to set the frac plug 208 would the setting tool include a valve or other actuator to direct the hydrostatic pressure). The frac plug 208 engages the casing string 16 to isolate the section of the wellbore 12 below the frac plug 208. In step 1014, the successful deployment of the frac plug 208 and engagement of the frac plug 208 element 524 with the inner wall of the wellbore string 16 is determined by monitoring the wellbore 12 fluid pressure. The setting tool 206 may include a pressure sensor thereon to and instructions stored therein to fire the perforating guns 204*a*, 204*b* after once an appropriate pressure increase is detected by the pressure sensor. In other embodiments, an operator at the surface may transmit a wireless signal to the setting tool 206 once it can be verified that the frac plug 208 was properly set. The perforating guns 204*a*, 204*b* may then be fired. In step 1015, the previously perforated and isolated sections in wellbore 12 (e.g., the section of the wellbore 12 above the frac plug 208) is stimulated and/or hydraulically fractured with a proppant, acid, or combination of proppant and acid. In step 1016, the process is repeated starting at step 1010 for multiple frac stages. In step 1017, after the final frac stage is complete the frac packages 48 are allowed to dissolve in the wellbore 12 over time.

Figure 11:
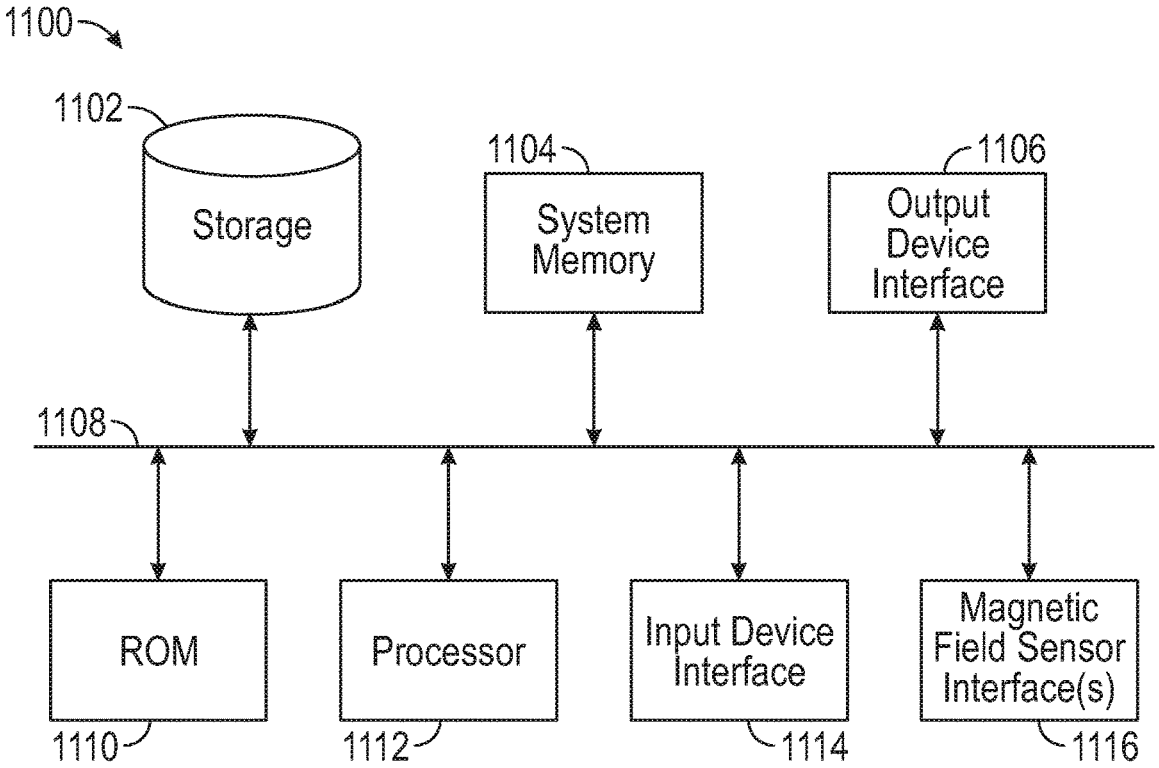
FIG. 11 is a block diagram of an exemplary computer system, portions of which may be housed in the dissolvable frac package setting tool and in which embodiments of the present disclosure may be implemented.

FIG. 11 is a block diagram of an exemplary computer system 1100 in which embodiments of the present disclosure may be implemented. For example, some steps of the procedure 1000 such as positioning the dissolvable frac package 48 downhole in wellbore 12, as described above, may be implemented using system 1100. System 1100 can be an electronic device housed in the dissolvable frac package 48 setting tools 206. Such an electronic device includes various types of electronic components and magnetic field detectors. As shown in FIG. 11, system 1100 includes a permanent storage device 1102, a system memory 1104, an output device interface 1106, a system communications bus 1108, a read-only memory (ROM) 1110, processing unit(s) 1112, an input device interface 1114, and a magnetic field sensor interface 1116.

Bus 1108 collectively represents all system, peripheral, and chipset buses that communicatively connect the numerous internal electronic components of system 1100. For instance, bus 1308 communicatively connects processing unit(s) 1112 with ROM 1110, system memory 1104, and permanent storage device 1102.

From these various memory units, processing unit(s) 1112 retrieves instructions to execute and data to process in order to execute the processes of the subject disclosure. The processing unit(s) can be a single processor or a multi-core processor in different implementations.

ROM 1110 stores static data and instructions that are needed by processing unit(s) 1112 and other modules of system 1100. Permanent storage device 1102, on the other hand, is a read-and-write memory device. This device is a non-volatile memory unit that stores instructions and data even when system 1100 is off. Some implementations of the subject disclosure use a mass-storage device (such as a magnetic or optical disk and its corresponding disk drive) as permanent storage device 1102.

Like permanent storage device 1102, system memory 1104 is a read-and-write memory device. However, unlike storage device 1102, system memory 1104 is a volatile read-and-write memory, such a random-access memory. System memory 1104 stores some of the instructions and data that the processor needs at runtime. In some implementations, the processes of the subject disclosure are stored in system memory 1104, permanent storage device 1102, and/or ROM 1110. For example, the various memory units include instructions for sensing, measuring the magnetic field from the array of magnets and/or counting the array of magnets disposed along the string and deploying the frac plug 208 element at a specific position along the wellbore 12, e.g., according to processes of FIG. 11 as described above. From these various memory units, processing unit(s) 1112 retrieves instructions to execute and data to process in order to execute the processes of some implementations.

Bus 1108 also connects to input and output device interfaces 1114 and 1106. Input device interface 1114 enables the user to communicate information and select commands to the system 1100. Input devices used with input device interface 1114 include, for example, alphanumeric, QWERTY, or T9 keyboards, microphones, and pointing devices (also called "cursor control devices"). Output device interfaces 1106 enables, for example, the display of images generated by the system 1100, and/or an initiation signal to an actuator that sets the frac plug or fires the perforating guns. Output devices used with output device interface 1106 include, for example, printers and display devices, such as cathode ray tubes (CRT) or liquid crystal displays (LCD). Some implementations include devices such as a touch-screen that functions as both input and output devices. It should be appreciated that embodiments of the present disclosure may be implemented using a computer including any of various types of input and output devices for enabling interaction with a user. Such interaction may include feedback to or from the user in different forms of sensory feedback including, but not limited to, visual feedback, auditory feedback, or tactile feedback. Further, input from the user can be received in any form including, but not limited to, acoustic, speech, or tactile input. Additionally, interaction with the user may include transmitting and receiving different types of information, e.g., in the form of documents, to and from the user via the above-described interfaces.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself. Accordingly, the steps for deploying a dissolvable frac package 48 of FIG. 1, as described above, may be implemented using system 1100 or any computer system having processing circuitry or a computer program product including instructions stored therein, which, when executed by at least one processor, causes the processor to perform functions relating to these methods.

It is understood that any specific order or hierarchy of steps in the processes disclosed is an illustration of exemplary approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Furthermore, the exemplary methodologies described herein may be implemented by a system including processing circuitry or a computer program product including instructions which, when executed by at least one processor, causes the processor to perform any of the methodology described herein.

Figure 12:
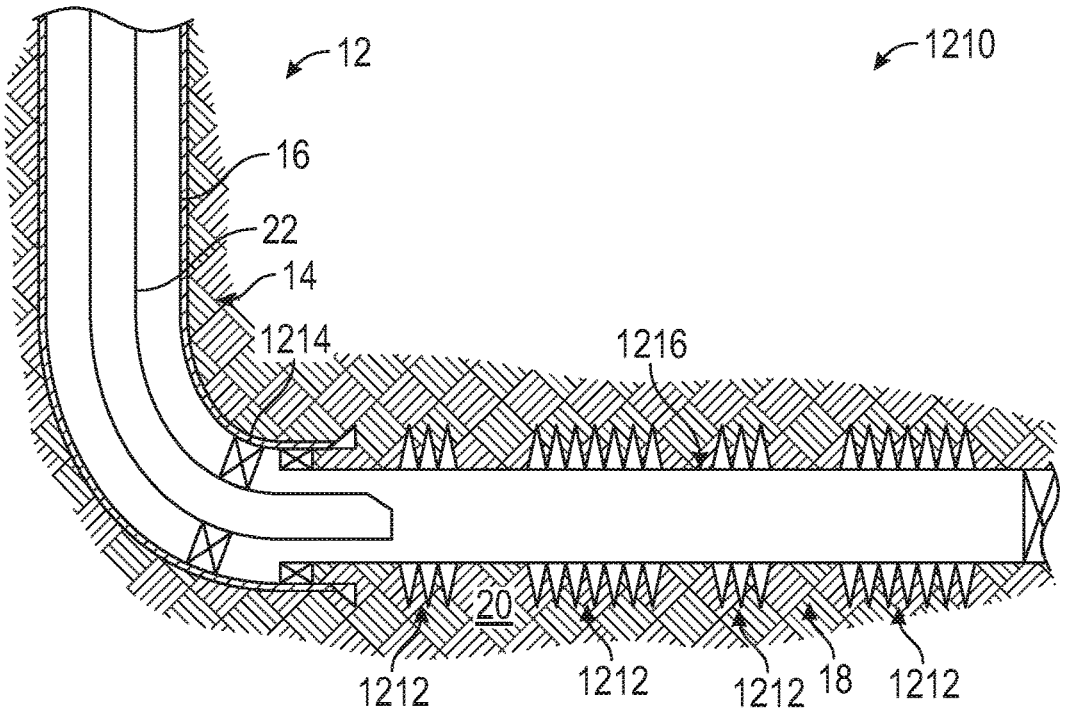
FIG. 12 is a schematic illustration of an alternate wellbore system wherein the frac package may have been deployed through a tubing string to create perforations through a liner installed in the horizontal section on the wellbore.

FIG. 12 illustrates an alternate wellbore system 1210, e.g., a production system, wherein a frac package 48 (see FIG. 1) may have been deployed to create perforations 1212 in another type of wellbore tubular. At a lower end of the tubing string 22, a production packer 1214 is installed in wellbore 12 between the tubing string 22 the casing string 16. A liner 1216 is installed in the horizontal section of the wellbore and extends through various production intervals adjacent to formation 20. Perforations may be formed through the liner 1216 in a manner similar to the perforations formed through the casing string 16 as described above. Once perforated and stimulated, production fluids may be produced from the formation 20 through the perforations 1212 into the liner 1216 in the horizontal section 18 of the wellbore 12. From the horizontal section 18, the production fluids may be produced to the surface through the tubing string 22 extending through the vertical section 14 of the wellbore.

As described above, embodiments of the present disclosure are particularly useful for deploying an untethered dissolvable frac package and locating a position downhole along the wellbore string. Aspects of the disclosure may also be employed for the orientation and installation of standard completion equipment (e.g. a packer) in a subterranean wellbore, to define the depth a shifting or positioning tool should become active to interact with a given completion device (e.g. a sleeve or side pocket mandrel), to identify the position of a device in the wellbore for feedback to surface.

In a first aspect, the present disclosure is directed to a dissolvable frac package with a magnetic field detector system located in the setting tool for determining a position within the casing string along the wellbore. The dissolvable frac package is operable to be pumped along both the vertical and horizontal sections of the wellbore. An array of magnets deployed in the completion string couplings is operable to produce a magnetic field. In one embodiment, the array of magnets may be deployed as part of the string tubulars where the array of magnets is disposed along the inner surface of the string and/or outer surface of the string prior to deployment of the string downhole. In another embodiment, the array of magnets could be part of the string joints. In yet another embodiment, the array of magnets could be embedded inside the string material itself. The dissolvable frac package includes a setting tool that is operable to sense the array of magnets deployed in the string couplings. The frac package also consist of a frac plug that has at least a first and second position relative to the setting tool of the frac package. In the first position, the frac plug is retracted. In the second position, the frac plug is extended to make contact with the inner casing wall. The position of the frac plug, relative to the setting tool of the frac package, is determined by detection of a magnetic signature produced by the array of magnets located along the string, thereby determining the operating location of the frac package along the string.

In one embodiment, the frac plug moves radially outward towards the inner wall of the string relative to the setting tool of the frac package. In another embodiment, the frac plug moves circumferentially relative to the setting tool of the frac package and extends radially outward towards the inner wall of the string. In some embodiments, the array of magnets deployed in the string coupling may be an azimuthally distributed array of magnets, a circumferentially distributed array of magnets, a longitudinally distributed array of magnets or a combination of the above. In certain embodiments, the string may consist of plurality of arrays of magnets spaced apart from one another along the string. In certain embodiments, the plurality of arrays of magnets may consist of a certain singular type of array distribution or be a combination of different types of array distributions. In certain embodiments, the array of magnets may include a digital address identifying a particular array of magnets and a position determining the array of magnets location along the casing string. In one such embodiment, the digital address identifying an array may be a circumferentially distributed array of magnets having a single axial layer and the position of the array of magnets may be determined by a longitudinal length of the distributed array of magnets. In a particular embodiment, the frac plug may have a plurality of positions relative to the setting tool of the frac package between the first and second positions such that a different degree of engagement with the inner casing wall is produced in each of the plurality of positions. In some embodiments, the magnetic field detector may include at least two magnetic field detector elements each operable to detect the magnetic signature produced by the plurality of array of magnets deployed along the casing string.

In a second aspect, the present disclosure is directed to a method to deploy the dissolvable frac package into the wellbore. The method includes lowering the frac package, via wireline to a distill end of the vertical section of the wellbore. Once the distill end of the vertical section of the wellbore is reached the wireline cable is detached and the now untethered dissolvable frac package is further pumped along the horizontal section of the wellbore. While the frac package is being pumped along the horizontal section of the wellbore the magnetic field detector senses the magnetic fields produced by each array of magnets deployed along the string. Once the frac package reaches a predetermined position along the string, the setting tool senses the magnetic field produced by the array of magnets and sets the frac plug either instantly or after a predetermined time period and or distance travelled. When the frac plug is deployed it creates fluid sealable contact with the inner wall of the string. Successful deployment and engagement of the frac plug with the inner wall of the string is confirmed by anticipated fluid backpressure production in the wellbore. In another embodiment, successful deployment and engagement of the frac plug with the inner string wall is confirmed by a confirmation signal sent by a transceiver element located in the frac package setting tool.

The method may also include radially shifting the frac package relative to the setting tool; rotatably shifting the frac plug relative to the setting tool; producing the magnetic field with an azimuthally distributed array of magnets located in the string couplings; producing the magnetic field with a circumferentially distributed array of magnets located in the string couplings; producing the magnetic field with a longitudinally distributed array of magnets located in the string couplings; producing the magnetic field with a combination of different array of magnets distributions located in the string couplings; identifying a digital address of the array of magnets; detecting a portion of the magnetic signature generated by an array of magnets having a single axial layer to identify the digital address; detecting a portion of the magnetic signature generated by an array of magnets to determine the position of the frac plug relative to the setting tool; generating a plurality of degrees movement with the frac plug to a plurality of positions relative to the setting tool; and/or detecting the magnetic signature of an array of magnets with at least one magnetic field detector element.

According to another aspect, a wellbore system useful in hydraulic fracturing or stimulation operations includes a wellbore string disposed within a wellbore, the wellbore string including at least one passive depth marker at a predetermined position along the wellbore string; an untethered frac package deployable through the wellbore string by pumping a fluid through the wellbore string, the frac package including a perforating gun, a frac plug, and a setting tool operably coupled to the perforating gun and the frac plug; a depth marker detector housed within the setting tool, the depth marker detector configured to detect the depth marker in the wellbore string; and at least one actuator operably coupled to the depth marker detector, the at least one actuator operable to induce perforating gun to fire and to move the frac plug from a first radially inward position to a second radially outward position in response to detecting the at least one passive depth marker with the depth marker detector.

In some embodiments, the perforating gun, a frac plug, and a setting tool are constructed of at least one dissolvable material. The at least one dissolvable material may include a dissolvable elastomer forming an element of the frac plug and a dissolvable metal forming a lower slip of the frac plug below the element of the frac plug in the wellbore. The passive depth marker may include an array of magnets and the depth marker detector may include a magnetic field detector. The array of magnets may be disposed with a coupling defined between tubulars of the wellbores string. The coupling may be constructed of a ferromagnetic material and wherein the array of magnets defines a width at least one quarter of a radial distance between the array of magnets and the magnetic field detector when the setting tool passes through the wellbore string. The wellbore system may further include a memory operably coupled to the depth marker detector and the at least one actuator, the memory including instructions stored thereon to cause the actuator to set the frac plug after a predetermined time delay from the depth marker detector detecting the at least one passive depth marker.

According to another aspect, a method for hydraulic fracturing or stimulation operations in a wellbore includes deploying an untethered frac package into a wellbore string in the wellbore; detecting at least one passive depth marker in the wellbore string with a depth marker detector carried by the untethered frac package; setting a frac plug carried by the untethered frac package in response to detecting the at least one passive depth marker to isolate a perforation zone in the wellbore; firing a first perforating gun carried by the frac package to create perforations in the perforation zone in response to detecting the at least one passive depth marker; and pumping a fluid into the perforation zone isolated by the frac plug to hydraulically fracture or stimulate the wellbore.

In some embodiments, the method further includes dissolving at least a portion of the untethered frac package in the wellbore subsequent to hydraulically fracturing or stimulating the wellbore. Pumping the fluid into the perforation zone may include pumping an acid into the perforation zone, and wherein dissolving at least a portion of the untethered frac package in the wellbore comprises dissolving an elastomer of the frac plug subsequent to hydraulically fracturing or stimulating the wellbore. Deploying the frac package into the wellbore string may include pumping a fluid through the wellbore string to propel the frac package though the wellbore string. The method may further include conveying the frac package through a vertical portion of the wellbore on a tubing string, and untethering the frac package from the tubing string and pumping the fluid through the wellbore string to propel the frac package through a horizontal portion of the wellbore. Detecting the at least one passive depth marker in the wellbore string may include detecting at least one magnetic field generated by the at least one passive depth marker. Detecting the at least one magnetic field may include detecting a plurality of magnetic fields as the frac package passes a plurality of magnets longitudinally spaced along the wellbore string, and the frac plug may be set in response to detecting a predetermined number of magnetic fields. The method may further include firing a second perforating gun carried by the frac package after a time delay after firing the first perforating gun.

According to another aspect, an untethered frac package apparatus useful in hydraulic fracturing or stimulation operations includes a perforating gun having charges for generating perforations in a wellbore; a frac plug having an element movable from a radially retracted configuration to a radially extended configuration; and a setting tool having a depth marker detector operably coupled to the perforating gun and the frac plug, the setting tool responsive to the depth marker detector detecting a predetermined passive depth marker in a wellbore to fire the perforating gun and to move the element of the frac plug from the radially retracted configuration to the radially extended configuration.

In some embodiments, the perforating gun, frac plug and setting tool are constructed of a dissolvable material. The perforating gun may be constructed of a dissolvable plastic, and the element of the frac plug may be constructed of a dissolvable elastomer. The depth marker detector may include a magnetic field detector, and the setting tool may be responsive to the magnetic field detector detecting a predetermined magnetic signature in the wellbore. The setting tool may further include a memory and a timer operatively coupled to the frac plug, the memory including instructions stored thereon to cause the element of the frac plug to move from the radially retracted configuration to the radially extended configuration after a predetermined time delay from the depth marker detector detecting the predetermined passive depth marker.

While specific details about the above embodiments have been described, the above hardware and software descriptions are intended merely as example embodiments and are not intended to limit the structure or implementation of the disclosed embodiments. For instance, although many other internal components of the system 1100 are not shown, those of ordinary skill in the art will appreciate that such components and their interconnection are well known.

In addition, certain aspects of the disclosed embodiments, as outlined above, may be embodied in software that is executed using one or more processing units/components. Program aspects of the technology may be thought of as "products" or "articles of manufacture" typically in the form of executable code and/or associated data that is carried on or embodied in a type of machine readable medium. Tangible non-transitory "storage" type media include any or all of the memory or other storage for the computers, processors or the like, or associated modules thereof, such as various semiconductor memories, tape drives, disk drives, optical or magnetic disks, and the like, which may provide storage at any time for the software programming.

Additionally, the flowchart and block diagrams in the figures illustrate the architecture, functionality, and operation of possible implementations of systems, methods and computer program products according to various embodiments of the present disclosure. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The above specific example embodiments are not intended to limit the scope of the claims. The example embodiments may be modified by including, excluding, or combining one or more features or functions described in the disclosure.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the embodiments in the form disclosed. Many modifications and variations will be apparent to those of ordinary skill in the art without departing from the scope and spirit of the disclosure. The illustrative embodiments described herein are provided to explain the principles of the disclosure and the practical application thereof, and to enable others of ordinary skill in the art to understand that the disclosed embodiments may be modified as desired for a particular implementation or use. The scope of the claims is intended to broadly cover the disclosed embodiments and any such modification.

What is claimed is:

1. A wellbore system useful in hydraulic fracturing or stimulation operations, the system comprising:

a wellbore string disposed within a wellbore, the wellbore string including at least one passive depth marker at a predetermined position along the wellbore string;

an untethered frac package including a perforating gun, a frac plug coupled to the perforating gun, and a single setting tool coupled to the perforating gun and the frac plug such that the perforating gun, the frac plug and the single setting tool are deployable together through the wellbore string by pumping a fluid through the wellbore string;

a depth marker detector housed within the single setting tool, the depth marker detector configured to detect the depth marker in the wellbore string; and a first actuator operably coupled to the depth marker detector, the first actuator operable to induce the perforating gun to fire;

a second actuator operably coupled to the depth marker detector, the second actuator operable to move the frac plug from a first radially inward position to a second radially outward position in response to detecting the at least one passive depth marker with the depth marker detector.

2. The wellbore system according to claim 1, wherein the perforating gun, the frac plug, and the single setting tool are constructed of at least one dissolvable material.

3. The wellbore system of claim 2, wherein the at least one dissolvable material includes a dissolvable elastomer forming an element of the frac plug and a dissolvable metal forming a lower slip of the frac plug below the element of the frac plug in the wellbore.

4. The wellbore system according to claim 1, wherein the passive depth marker includes an array of magnets and the depth marker detector includes a magnetic field detector.

5. The system of claim 4, wherein the array of magnets is disposed with a coupling defined between tubulars of the wellbore string.

6. The wellbore system according to claim 5, wherein the coupling is constructed of a ferromagnetic material and wherein the array of magnets defines a width at least one quarter of a radial distance between the array of magnets and the magnetic field detector when the single setting tool passes through the wellbore string.

7. The wellbore system according to claim 1, further comprising a memory operably coupled to the depth marker detector and the at least one actuator, the memory including instructions stored thereon to cause the actuator to set the frac plug after a predetermined time delay from the depth marker detector detecting the at least one passive depth marker.

8. A method for hydraulic fracturing or stimulation operations in a wellbore, the method comprising:

deploying an untethered frac package into a wellbore string in the wellbore, the untethered frac package including a perforating gun, a frac plug and a single setting tool coupled to one another are such that the perforating gun, the frac plug and the single setting tool are deployable together through the wellbore string by pumping a fluid through the wellbore string;

detecting at least one passive depth marker in the wellbore string with a depth marker detector carried by the single setting tool of the untethered frac package;

setting a frac plug with a first actuator carried by the single setting tool of the untethered frac package in response to detecting the at least one passive depth marker to isolate a perforation zone in the wellbore;

firing a first perforating gun with a second actuator carried by the single setting tool of the frac package to create perforations in the perforation zone in response to detecting the at least one passive depth marker; and pumping a fluid into the perforation zone isolated by the frac plug to hydraulically fracture or stimulate the wellbore.

9. The method according to claim 8, further comprising dissolving at least a portion of the untethered frac package in the wellbore subsequent to hydraulically fracturing or stimulating the wellbore.

10. The method according to claim 9, wherein pumping the fluid into the perforation zone comprises pumping an acid into the perforation zone, and wherein dissolving at least a portion of the untethered frac package in the wellbore comprises dissolving an elastomer of the frac plug subsequent to hydraulically fracturing or stimulating the wellbore.

11. The method according to claim 8, wherein deploying the frac package into the wellbore string includes pumping a fluid through the wellbore string to propel the frac package though the wellbore string.

12. The method according to claim 11, further comprising conveying the frac package through a vertical portion of the wellbore on a tubing string, and untethering the frac package from the tubing string and pumping the fluid through the wellbore string to propel the frac package through a horizontal portion of the wellbore.

13. The method according to claim 8, wherein detecting the at least one passive depth marker in the wellbore string includes detecting at least one magnetic field generated by the at least one passive depth marker.

14. The method according to claim 13, wherein detecting the at least one magnetic field comprises detecting a plurality of magnetic fields as the frac package passes a plurality of magnets longitudinally spaced along the wellbore string, and wherein the frac plug is set in response to detecting a predetermined number of magnetic fields.

15. The method according to claim 8, further comprising firing a second perforating gun carried by the frac package after a time delay after firing the first perforating gun.

16. An untethered frac package apparatus useful in hydraulic fracturing or stimulation operations, the apparatus comprising:

a perforating gun having charges for generating perforations in a wellbore;

a frac plug coupled to the perforating gun having an element movable from a radially retracted configuration to a radially extended configuration; and a single setting tool coupled to the frac plug and the perforating gun, the single setting tool having a depth marker detector operably coupled to the perforating gun and the frac plug, the setting tool responsive to the depth marker detector detecting a predetermined passive depth marker in a wellbore to fire the perforating gun and to move the element of the frac plug from the radially retracted configuration to the radially extended configuration.

17. The apparatus of claim 16, wherein the perforating gun, frac plug and single setting tool are constructed of a dissolvable material.

18. The apparatus of claim 17, wherein the perforating gun is constructed of a dissolvable plastic, and wherein the element of the frac plug is constructed of a dissolvable elastomer.

19. The apparatus of claim 16, wherein the depth marker detector includes a magnetic field detector, and wherein the single setting tool is responsive to the magnetic field detector detecting a predetermined magnetic signature in the wellbore.

20. The apparatus of claim 19, wherein the single setting tool further comprises a memory and a timer operatively coupled to the frac plug, the memory including instructions stored thereon to cause the element of the frac plug to move from the radially retracted configuration to the radially extended configuration after a predetermined time delay from the depth marker detector detecting the predetermined passive depth marker.

* * * * *